US007575670B1

(12) United States Patent
VanWees

(10) Patent No.: US 7,575,670 B1
(45) Date of Patent: Aug. 18, 2009

(54) PROCESS FOR THE PRODUCTION OF LOW SULFUR DIESEL FROM AN ASPHALTENE-CONTAININGS FEEDSTOCK

(75) Inventor: Mark VanWees, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 379 days.

(21) Appl. No.: 11/438,629

(22) Filed: May 22, 2006

(51) Int. Cl.
*C10G 45/02* (2006.01)
*C10G 45/04* (2006.01)

(52) U.S. Cl. ..... 208/212; 208/210; 208/213; 208/218

(58) Field of Classification Search ..... 208/210, 208/211, 212, 213, 218
See application file for complete search history.

(56) References Cited

U.S. PATENT DOCUMENTS 4,401,561 A * 8/1983 Thompson et al. ..... 208/212
4,422,927 A * 12/1983 Kowalczyk et al. ..... 208/211
4,810,361 A 3/1989 Absil et al. ..... 208/213
6,303,020 B1 * 10/2001 Podrebarac et al. ..... 208/210
6,787,026 B2 * 9/2004 Farshid ..... 208/89
6,793,804 B1 * 9/2004 Lindsay et al. ..... 208/210
6,797,154 B2 * 9/2004 Mukherjee et al. ..... 208/58
6,843,906 B1 * 1/2005 Eng ..... 208/210
7,384,540 B2 * 6/2008 Galeazzi ..... 208/210

* cited by examiner

*Primary Examiner*—Tam M Nguyen
(74) *Attorney, Agent, or Firm*—James C Paschall

(57) ABSTRACT

A process for the production of low sulfur diesel and a residual hydro-carbon stream containing a reduced concentration of sulfur. A residual hydrocarbon stream is desulfurized and the resulting diesel boiling range hydrocarbons are desulfurized in a second desulfurization zone to produce low sulfur diesel. Hydrogen sulfide is removed from the process by the purification of the recycle gas.

19 Claims, 1 Drawing Sheet

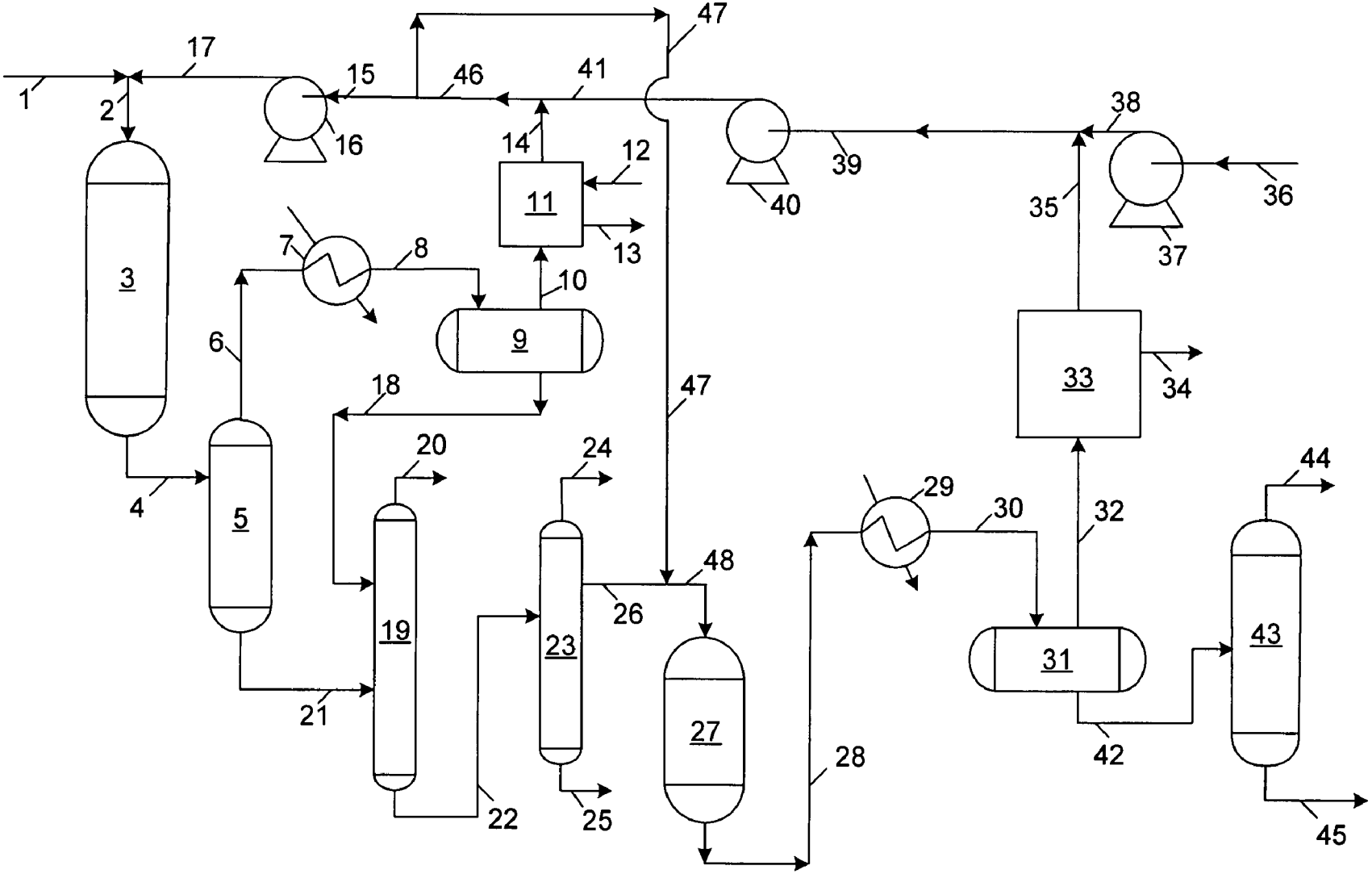
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48

PROCESS FOR THE PRODUCTION OF LOW SULFUR DIESEL FROM AN ASPHALTENE-CONTAININGS FEEDSTOCK

FIELD OF THE INVENTION

The field of art to which this invention pertains is the catalytic conversion of a low value hydrocarbon feedstock to produce useful hydrocarbon products including low sulfur diesel by two-stage hydrodesulfurization.

BACKGROUND OF THE INVENTION

Refiners subject low value hydrocarbons such as residual hydrocarbon streams to hydrodesulfurization to produce heavy hydrocarbonaceous compounds having a reduced concentration of sulfur. Residual hydrocarbons contain the heaviest components in a crude oil and a significant portion is non-distillable such as asphaltenes which are high molecular weight hydrocarbons. Residual hydrocarbon streams are the remainder after the distillate hydrocarbons have been removed or fractionated from a crude oil. A majority of the residual feedstock boils at a temperature greater than about 565° C. (1050° F.). During the desulfurization of residual hydrocarbon feedstocks, a certain amount of distillate hydrocarbons are produced including diesel boiling range hydrocarbons. However, the diesel boiling range hydrocarbons thereby produced typically fail to qualify as low sulfur diesel because of their relatively high sulfur concentration. Although a wide variety of process flow schemes, operating conditions and catalysts have been used in commercial activities, there is always a demand for new hydroprocessing methods which provide lower costs, more valuable product yields and improved operability.

INFORMATION DISCLOSURE

U.S. Pat. No. 4,810,361 (Absil et al.) discloses a process for upgrading petroleum residua. The process comprises contacting a vacuum or atmospheric resid feed with a catalyst whereby the resid feedstock is simultaneously demetalized and desulfurized.

BRIEF SUMMARY OF THE INVENTION

The present invention is an integrated process for the production of low sulfur diesel and a residual hydrocarbon stream containing a reduced concentration of sulfur. The process of the present invention utilizes a residual hydrocarbon feedstock which is reacted with a hydrogen-rich gaseous stream in a first hydrodesulfurization reaction zone to produce diesel boiling range hydrocarbons and a residual product stream having a reduced concentration of sulfur. The effluent from the first hydrodesulfurization reaction zone is separated in a hot, high pressure vapor liquid separator to produce a vaporous hydrocarbonaceous stream containing hydrogen and diesel boiling range hydrocarbons, and a residual liquid hydrocarbonaceous stream having a reduced concentration of sulfur. The vaporous stream containing diesel boiling range hydrocarbons and hydrogen is partially condensed and separated to provide a first hydrogen rich gaseous stream and a liquid hydrocarbonaceous stream containing diesel boiling range hydrocarbons. The diesel boiling range hydrocarbons and at least a portion of the first hydrogen-rich gaseous stream is reacted in a second hydrodesulfurization reaction zone to produce a second hydrogen-rich gaseous stream containing hydrogen sulfide and a stream comprising low sulfur diesel. At least a portion of the hydrogen sulfide from the second hydrogen-rich gaseous stream is rejected to increase the purity thereof which is recycled to the first and second hydrodesulfurization reaction zones. In one preferred embodiment, the hydrogen sulfide is rejected in a membrane purification zone. In another preferred embodiment, the hydrogen sulfide is removed in a scrubbing zone. In yet another preferred embodiment, the hydrogen sulfide is removed in a pressure swing adsorption (PSA) process.

The integration of two hydrodesulfurization reaction zones utilizing a single hydrogen gas circuit with hydrogen sulfide removal minimizes the requirement for compression equipment and thereby reduces the investment and operating cost for the desulfurization of an asphaltene-containing residual feedstock and the production of merchantable low sulfur diesel from the diesel range boiling hydrocarbons simultaneously produced during the desulfurization of the primary feedstock.

Other embodiments of the present invention encompass further details, such as detailed description of feedstocks, hydrodesulfurization catalyst, hydrogen removal systems, and preferred operating conditions, all of which are hereinafter disclosed in the following discussion of each of these facets of the invention.

BRIEF DESCRIPTION OF THE DRAWING

The drawing is a simplified process flow diagram of a preferred embodiment of the present invention. The above described drawing is intended to be schematically illustrative of the present invention and is not to be a limitation thereof.

DETAILED DESCRIPTION OF THE INVENTION

The present invention is a process for the hydrodesulfurization of a residual hydrocarbon feedstock and the subsequent hydrodesulfurization of the diesel boiling range hydrocarbons produced in the residual hydrocarbon feedstock hydrodesulfurization. Preferred residual hydrocarbon feedstocks to the first hydrodesulfurization reaction zone include a vacuum or atmospheric resid produced during the fractionation of crude oil. Preferred residual hydrocarbon feedstocks have at least about 25 volume percent boiling at a temperature greater than 565° C. (1050° F.). A more preferred residual hydrocarbon feedstock has at least about 50 volume percent boiling at a temperature greater than 565° C. 1050° F.).

The residual hydrocarbon feedstock is reacted with a hydrogen-rich gaseous stream in a hydrodesulfurization reaction zone to produce diesel boiling range hydrocarbons, and residual hydrocarbons containing asphaltenes and having a reduced concentration of sulfur. The hydrodesulfurization reaction zone performs non-distillable conversion of the feedstock as well as desulfurization. The resulting effluent from the hydrodesulfurization reaction zone is introduced into a hot, vapor liquid separator preferably operated at a pressure from about 4.9 MPa (700 psig) to about 20.7 MPa (3000 psig) and a temperature from about 204° C. (400° F.) to about 454° C. (850° F.) to produce a vaporous stream comprising diesel boiling range hydrocarbons and hydrogen, and a liquid hydrocarbonaceous stream comprising asphaltenes and having a reduced concentration of sulfur.

The first hydrodesulfurization reaction zone is preferably operated at conditions including a temperature from about 260° C. (500° F.) to about 454° C. (850° F.) and a pressure from about 7.0 MPa (1000 psig) to about 20.7 MPa (3000 psig).

Suitable desulfurization catalysts for use in the present invention are any known convention desulfurization catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalyst include zeolitic catalysts, as well as noble metal catalysts where the noble metal is selected from palladium and platinum. It is within the scope of the present invention that more than one type of desulfurization catalyst be used in the same reaction vessel. Two or more catalyst beds and one or more quench points may be utilized in the reaction vessel or vessels. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The liquid hydrocarbonaceous stream comprising asphaltenes and having a reduced concentration of sulfur recovered from the hot, vapor liquid separator is preferably introduced into a fractionation zone to provide a feed for a fluid catalytic cracker or a low sulfur fuel oil product stream. The vaporous stream comprising diesel boiling range hydrocarbons and hydrogen from the hot, vapor liquid separator is cooled and partially condensed to provide a first hydrogen-rich gaseous stream and a liquid hydrocarbonaceous stream containing diesel boiling range hydrocarbons. Diesel boiling range hydrocarbons and at least a portion of the first hydrogen-rich gaseous stream are reacted in a second hydrodesulfurization reaction zone to produce a second hydrodesulfurization reaction zone which is separated to provide a second hydrogen-rich gaseous stream containing hydrogen sulfide and a stream containing ultralow sulfur diesel.

The second hydrodesulfurization reaction zone is preferably operated at conditions including a temperature from about 204° C. (400° F.) to about 454° C. (850° F.) and a pressure from about 4.9 MPa (700 psig) to about 17.3 MPa (2500 psig). The operating pressure of the second hydrodesulfurization reaction zone is preferably operated at a pressure lower than that in the first hydrodesulfurization zone. Since the operating conditions in the second hydrodesulfurization reaction conditions will preferably be found to be less severe than those in the first hydrodesulfurization conditions, the hydrogen required is provided as a purge hydrogen stream from the first hydrodesulfurization reaction zone. The hydrogen purge provided to the second hydrodesulfurization reaction zone will be operated on a once thru basis and therefore no recycle gas compressor is required. The hydrogen-rich gaseous stream recovered from the second hydrodesulfurization reaction zone effluent contains hydrogen sulfide which must be removed to provide a higher concentration of hydrogen in the recycle gas to the first hydrodesulfurization reaction zone. The low sulfur diesel recovered from the second hydrodesulfurization reaction zone preferably contains less than about 100 ppm sulfur and more preferably less than about 10 ppm sulfur which is conventionally described as ultralow sulfur diesel.

In one embodiment, the hydrogen rich gaseous stream recovered from the second hydrodesulfurization reaction zone is scrubbed with an aqueous amine solution or any other suitable liquid hydrogen sulfide scavenger to produce a hydrogen rich gaseous stream having a reduced concentration of hydrogen sulfide which is preferably compressed and recycled to the first hydrodesulfurization reaction zone. The hydrogen sulfide scrubber is preferably operated in counter-current flow with the hydrogen rich gas containing hydrogen sulfide flowing upwardly through a descending stream of a lean liquid scrubber solution. A rich scrubber solution containing absorbed hydrogen sulfide is then preferably removed from a lower portion of the scrubber. A resulting hydrogen rich gaseous stream having a reduced concentration of hydrogen sulfide is recovered from an upper portion of the scrubber, compressed and recycled. Preferred operating conditions of the scrubber include a pressure essentially equal to the pressure in the second hydrodesulfurization reaction zone and approximately ambient temperature. Other scrubber operating conditions will readily be known to those skilled in the art.

In another embodiment, the hydrogen rich gaseous stream recovered from the second hydrodesulfurization reaction zone is separated in a membrane purification unit to provide a hydrogen rich gaseous stream having a reduced concentration of hydrogen sulfide and a rejected stream containing hydrogen sulfide.

The membrane system is incorporated in a separate enclosure or vessel and contains a desired membrane structure capable of selectively permeating a more readily permeable component of a feed gas mixture containing the component and a less readily permeable component. Thus, membranes of the composite type, asymmetric type membranes or any other suitable form of membrane configuration can be employed. Composite membranes generally comprise a thin separation layer or coating of a suitable permeable membrane material superimposed on a porous substrate, with the separation layer determining the separation characteristics of the composite structure. Asymmetric membranes are composed essentially of a single permeable membrane material having a thin dense semi-permeable skin that determines the separation characteristics of the membrane and a less dense, porous, non-selective support region that serves to preclude the collapse of the skin region under pressure. Such membrane structures may be prepared in a variety of forms, such as spiral wound, hollow fiber and flat sheet, for example.

Such membrane structures may be employed in membrane assemblies that are typically positioned within enclosures to form a membrane module that comprises the principal element of an overall membrane system. The membrane system may be a membrane module or a number of such modules and arranged for either parallel or series operation.

The membrane modules may be constructed in the form of spiral wound cartridges, hollow fiber bundles, pleated flat sheet membrane assemblies, and other such assemblies common in the membrane industry. The membrane module is preferably constructed to have a feed-surface side and an opposite permeate exit side and the enclosure portion thereof is preferably constructed to permit the hydrogen feed stream mixture to be brought into contact with the membrane feed-surface side. Piping is provided for the removal of the non-permeate portion of the feed stream and for separate removal of the permeate gas that has passed through the membrane. Further design details and operating conditions will be readily available to a person skilled in the art of membrane separation.

In yet another embodiment, the hydrogen rich gaseous stream recovered from the second hydrodesulfurization reaction zone is separated in a pressure swing adsorption (PSA) process or unit to provide a hydrogen rich gaseous stream having a reduced concentration of hydrogen sulfide and a rejected stream containing hydrogen sulfide.

The pressure swing adsorption (PSA) process provides a well established means for separating and purifying at least one gas component from a feed gas mixture of the component and at least one selectively adsorbable component. The process includes adsorption of the selectively adsorbable component at a higher adsorption pressure and pressure reduction to a lower desorption pressure to desorb the selectively adsorbably component. It is generally desirable to employ the PSA process in multiple bed systems such as those described in U.S. Pat. No. 3,430,418 in which at least four adsorption beds are employed. The PSA process is carried out in such systems on a cyclic basis, employing a processing sequence that includes (1) high pressure adsorption, (2) cocurrent depressurization to intermediate pressure levels, with release of void space gas from the product end of the bed, (3) countercurrent depressurization or blow down to a lower desorption pressure bed, (4) repressurization to the higher adsorption pressure. In the process of the present invention hydrogen sulfide is adsorbable on the adsorbent which increases purity of the resulting hydrogen rich gaseous stream being subjected to the PSA unit. Further details and operating conditions of the PSA unit will readily be known to those skilled in the PSA art.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

Referring now to the drawing, an asphaltene containing residual hydrocarbon feedstock is introduced into the process via line 1 and is admixed with a hydrogen-rich recycle gas stream provided via line 17 and the resulting admixture is carried via line 2 and introduced into hydrodesulfurization zone 3. A resulting effluent from hydrodesulfurization zone 3 is carried via line 4 and introduced into hot vapor liquid separator 5. A vaporous hydrocarbonaceous stream containing diesel boiling range hydrocarbons is removed from hot vapor liquid separator 5 via line 6 and is introduced into heat exchanger 7. A resulting cooled and partially condensed stream is removed from heat exchanger 7 via line 8 and introduced into cold vapor liquid separator 9. A hydrogen-rich gaseous stream containing hydrogen sulfide is removed from cold vapor liquid separator 9 via line 10 and introduced into absorption zone 11. A lean amine absorption solution is introduced via line 12 into absorption zone 11 and a rich amine solution containing hydrogen sulfide was removed from absorption zone 11 via line 13. A hydrogen rich gaseous stream having a reduced concentration of hydrogen sulfide is removed from absorption zone 11 via line 14 and joins a hereinafter described hydrogen-rich recycle gas stream provided via line 41 and the resulting admixture is transported via lines 46 and 15 and introduced into recycle gas compressor 16. A compressed hydrogen-rich recycle gas stream is removed from recycle gas compressor 16 via line 17 and is introduced into hydrodesulfurization zone 3 via lines 17 and 2. A liquid hydrocarbonaceous stream is removed from cold vapor liquid separator 9 via line 18 and introduced into stripper 19. An overhead stream containing naphtha boiling range hydrocarbons is removed from stripper 19 via line 20 and recovered. A liquid hydrocarbonaceous stream containing hydrocarbons having a reduced concentration of sulfur is removed from hot vapor liquid separator 5 via line 21 and introduced into stripper 19. A liquid hydrocarbonaceous stream is removed from stripper 19 via line 22 and introduced into fractionation zone 23. An overhead stream containing heavy naphtha boiling range hydrocarbons is removed from fractionation zone 23 via line 24 and recovered. A heavy hydrocarbonaceous stream containing hydrocarbons having a reduced concentration of sulfur is removed from fractionation zone 23 via line 25 and recovered. A mid cut stream containing diesel boiling range hydrocarbons is removed from fractionation zone 23 via line 26 and is admixed with a hydrogen-rich gaseous stream provided via line 47 and the resulting admixture is carried via line 48 and introduced into hydrodesulfurization zone 27. A hydrocarbonaceous effluent stream containing diesel boiling range hydrocarbons and having a reduced concentration of sulfur is removed from hydrodesulfurization zone 27 via line 28 and introduced into heat exchanger 29. A resulting cooled and partially condensed stream is removed from heat exchanger 29 via line 30 and introduced into cold vapor liquid separator 31. A hydrogen-rich gaseous stream containing hydrogen sulfide is removed from cold vapor liquid separator 31 via line 32 and introduced into purification zone 33. A stream rich in hydrogen sulfide is removed from purification zone 33 via line 34. Purification zone 33 may be a membrane separation purification zone, a scrubbing zone or a pressure swing adsorption zone, for example. A hydrogen-rich gaseous stream having a reduced concentration of hydrogen sulfide is removed from purification zone 33 via line 35 and is joined with a hydrogen makeup stream provided via lines 36, compressor 37 and line 38. The resulting hydrogen-rich gaseous stream is carried via line 39 and introduced into compressor 40. A compressed hydrogen-rich gaseous stream is removed from compressor 40 and is carried via line 41 and is utilized as hereinabove described. A liquid hydrocarbon stream containing diesel boiling range hydrocarbons having a reduced concentration of sulfur is removed from cold vapor liquid separator 31 via line 42 and introduced into stripper 43. An overhead stream containing naphtha boiling range hydrocarbons is removed from stripper 43 via line 44 and recovered. An ultralow sulfur diesel product stream is removed from stripper 43 via line 45 and recovered.

The foregoing description and drawing clearly illustrate the advantages encompassed by the process of the present invention and the benefits to be afforded with the use thereof.

What is claimed is:

1. A process for the production of low sulfur diesel from a low quality feedstock which process comprises:

a) reacting a feedstock having at least a portion boiling at greater than 565° C. (1050° F.) and hydrogen in a first hydrodesulfurization reaction zone containing hydrodesulfurization catalyst to produce a first hydrodesulfurization reaction zone effluent stream comprising diesel boiling range hydrocarbons and hydrocarbons having a reduced concentration of sulfur, and hydrogen;

b) recovering a liquid hydrocarbonaceous stream having at least a portion boiling at greater than 565° C. (1050° F.) and a reduced concentration of sulfur, a liquid hydrocarbonaceous stream comprising diesel boiling range hydrocarbons and first hydrogen-rich gaseous stream;

c) reacting the liquid hydrocarbonaceous stream comprising diesel boiling range hydrocarbons and at least a portion of the first hydrogen-rich gaseous stream in a second hydrodesulfurization reaction zone to produce a second hydrodesulfurization reaction zone effluent, wherein the first hydrodesulfurization reaction zone is operated at a pressure greater than the pressure in the second hydrodesulfurization reaction zone;

d) separating the second hydrodesulfurization reaction zone effluent to provide a second hydrogen-rich gaseous stream containing hydrogen sulfide and a stream comprising low sulfur diesel;

e) rejecting at least a portion of the hydrogen sulfide from the second hydrogen-rich gaseous stream containing hydrogen sulfide; and f) recycling at least a portion of the second hydrogen rich gaseous stream having a reduced concentration of hydrogen sulfide to the first hydrodesulfurization reaction zone.

2. The process of claim 1 wherein at least 25 volume percent of the feedstock boils at a temperature greater than 565° C. (1050° F.).

3. The process of claim 1 wherein the first hydrodesulfurization reaction zone is operated at conditions including a pressure from about 7.0 MPa (1000 psig) to about 20.7 MPa (3000 psig) and a temperature from about 204° C. (400° F.) to about 454° C. (850° F.).

4. The process of claim 1 wherein the second hydrodesulfurization reaction zone is operated at conditions including a pressure from about 4.9 MPa (700 psig) to about 17.3 MPa (2500 psig) and a temperature from about 204° C. (400° F.) to about 454° C. (850° F.).

5. The process of claim 1 wherein the stream comprising low sulfur diesel contains less than about 100 ppm sulfur.

6. The process of claim 1 wherein step (e) is performed by a method selected from the group consisting of a membrane separation purification zone, a scrubbing zone and a pressure swing adsorption zone.

7. A process for the production of low sulfur diesel from a low quality feedstock which process comprises:

a) reacting a feedstock having at least a portion boiling at greater than 565° C. (1050° F.) and hydrogen in a first hydrodesulfurization reaction zone containing hydrodesulfurization catalyst to produce a first hydrodesulfurization reaction zone effluent stream comprising diesel boiling range hydrocarbons and hydrocarbons having a reduced concentration of sulfur, and hydrogen;

b) separating the first hydrodesulfurization reaction zone effluent stream to provide a vaporous stream comprising diesel boiling range hydrocarbons and hydrogen, and a liquid hydrocarbonaceous stream having a reduced concentration of sulfur;

c) partially condensing the vaporous stream comprising diesel boiling range hydrocarbons and hydrogen to provide a first hydrogen-rich gaseous stream and a liquid hydrocarbonaceous stream comprising diesel boiling range hydrocarbons;

d) reacting diesel boiling range hydrocarbons and at least a portion of the first hydrogen-rich gaseous stream in a second hydrodesulfurization reaction zone to produce a second hydrodesulfurization reaction zone effluent, wherein said at least a portion of the first hydrogen-rich gaseous stream is purged from a line upstream of a recycle gas compressor and is introduced into said second hydrodesulfurization reaction zone;

e) separating the second hydrodesulfurization reaction zone effluent to provide a second hydrogen-rich gaseous stream containing hydrogen sulfide and a stream comprising low sulfur diesel;

f) rejecting at least a portion of the hydrogen sulfide from the second hydrogen-rich gaseous stream containing hydrogen sulfide, and g) recycling at least a portion of the second hydrogen rich gaseous stream having a reduced concentration of hydrogen sulfide to the first hydrodesulfurization reaction zone.

8. The process of claim 7 wherein at least 25 volume percent of the feedstock boils at a temperature greater than 565° C. (1050° F.).

9. The process of claim 7 wherein the first hydrodesulfurization reaction zone is operated at a pressure greater than the pressure in the second hydrodesulfurization reaction zone.

10. The process of claim 7 wherein the first hydrodesulfurization reaction zone is operated at conditions including a pressure from about 7.0 MPa (1000 psig) to about 20.7 MPa (3000 psig) and a temperature from about 204° C. (400° F.) to about 454° C. (850° F.).

11. The process of claim 7 wherein the second hydrodesulfurization reaction zone is operated at conditions including a pressure from about 4.9 MPa (700 psig) to about 17.3 MPa (2500 psig) and a temperature from about 204° C. (400° F.) to about 454° C. (850° F.).

12. The process of claim 7 wherein the stream comprising low sulfur diesel contains less than about 100 ppm sulfur.

13. The process of claim 7 wherein step (f) is performed by a method selected from the group consisting of a membrane separation purification zone, a scrubbing zone and a pressure swing adsorption zone.

14. A process for the production of ultralow sulfur diesel from a low quality feedstock which process comprises:

a) reacting a feedstock having at least a portion boiling at greater than 565° C. (1050° F.) and hydrogen in a first hydrodesulfurization reaction zone containing hydrodesulfurization catalyst to produce a first hydrodesulfurization reaction zone effluent stream comprising diesel boiling range hydrocarbons and hydrocarbons having a reduced concentration of sulfur, and hydrogen;

b) separating the first hydrodesulfurization reaction zone effluent stream to provide a vaporous stream comprising diesel boiling range hydrocarbons and hydrogen, and a liquid hydrocarbonaceous stream comprising asphaltenes and having a reduced concentration of sulfur;

c) partially condensing the vaporous stream comprising diesel boiling range hydrocarbons and hydrogen to provide a first hydrogen rich gaseous stream and a liquid hydrocarbonaceous stream comprising diesel boiling range hydrocarbons;

d) reacting diesel boiling range hydrocarbons and at least a portion of the first hydrogen rich gaseous stream in a second hydrodesulfurization reaction zone to produce a second hydrodesulfurization reaction zone effluent;

e) separating the second hydrodesulfurization reaction zone effluent to provide a second hydrogen rich gaseous stream containing hydrogen sulfide and a stream comprising ultralow sulfur diesel;

f) rejecting at least a portion of the hydrogen sulfide from the second hydrogen rich gaseous stream containing hydrogen sulfide in a membrane purification zone; and g) recycling at least a portion of the second hydrogen rich gaseous stream having a reduced concentration of hydrogen sulfide to the first hydrodesulfurization reaction zone.

15. The process of claim 14 wherein at least 25 volume percent of the feedstock boils at a temperature greater than 565° C. (1050° F.).

16. The process of claim 14 wherein the first hydrodesulfurization reaction zone is operated at a pressure greater than the pressure in the second hydrodesulfurization reaction zone.

17. The process of claim 14 wherein the first hydrodesulfurization reaction zone is operated at conditions including a pressure from about 7.0 MPa (1000 psig) to about 20.7 MPa (3000 psig) and a temperature from about 204° C. (400° F.) to about 454° C. (850° F.).

18. The process of claim 14 wherein the second hydrodesulfurization reaction zone is operated at conditions including a pressure from about 4.9 MPa (700 psig) to about 17.3 MPa (2500 psig) and a temperature from about 204° C. (400° F.) to about 454° C. (850° F.).

19. The process of claim 14 wherein the stream comprising low sulfur diesel contains less than about 100 ppm sulfur.

* * * * *

UNITED STATES PATENT AND TRADEMARK OFFICE

CERTIFICATE OF CORRECTION

PATENT NO. : 7,575,670 B1
APPLICATION NO. : 11/438629
DATED : August 18, 2009
INVENTOR(S) : Mark VanWees It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 467 days.

Signed and Sealed this

Seventh Day of September, 2010

David J. Kappos

David J. Kappos
*Director of the United States Patent and Trademark Office*